United States Patent [19]

Dinkelmann et al.

[11] Patent Number: 4,781,015

[45] Date of Patent: Nov. 1, 1988

[54] TANGENTIAL BELT DRIVE

[75] Inventors: Friedrich Dinkelmann, Rechberghausen; Ernst Halder, Ebersbach/Fils; Norbert Städele, Göppingen, all of Fed. Rep. of Germany

[73] Assignee: Zinser Textilmaschinen GmbH, Ebersbach/Fils, Fed. Rep. of Germany

[21] Appl. No.: 27,030

[22] PCT Filed: Oct. 16, 1985

[86] PCT No.: PCT/DE85/00401

§ 371 Date: Jan. 23, 1987

§ 102(e) Date: Jan. 23, 1987

[87] PCT Pub. No.: WO86/07101

PCT Pub. Date: Dec. 4, 1986

[30] Foreign Application Priority Data

May 25, 1985 [DE] Fed. Rep. of Germany ..... 3518998
May 31, 1985 [DE] Fed. Rep. of Germany ..... 3519540

[51] Int. Cl.[4] ..... D01H 1/241; F16G 1/14; F16H 7/02

[52] U.S. Cl. ..... 57/105; 57/100; 57/104; 474/148; 474/237

[58] Field of Search ..... 57/104, 105, 100, 88, 57/89; 474/148, 237, 260–269

[56] References Cited

U.S. PATENT DOCUMENTS 3,952,495 4/1976 Petty ..... 57/105
3,974,633 8/1976 Clevenger ..... 57/105 X
4,090,348 5/1978 DeVittorio ..... 57/105

FOREIGN PATENT DOCUMENTS 2204593 12/1974 Fed. Rep. of Germany .
2931716 2/1981 Fed. Rep. of Germany .
3500171 7/1986 Fed. Rep. of Germany .
2344654 10/1977 France .

*Primary Examiner*—John Petrakes
*Attorney, Agent, or Firm*—Herbert Dubno

[57] ABSTRACT

The invention relates to a tangential belt drive for a plurality of similar work units of a machine for the production of twisted or twined yarn. These units are subdivided into sections each having at least approximately the same number of work units and each driven through a tangential belt by an electric motor. Thereby, the number of work units in each section is established taking into account the required power and permissible belt stretch, so that the tangential belts have a considerably reduced width and thickness, compared to the ones commonly used. Further, the guide rollers of the tangential belts of neighboring sections are corotationally connected to each other.

In order to improve synchronization and power transmission between sections, the contact angle is increased at the guide rollers and the drive pulleys. This may be done through the corresponding spatial arrangement of the drive pulleys with respect to the guide rollers or through use of an intermediate belt arrangement.

21 Claims, 4 Drawing Sheets

TANGENTIAL BELT DRIVE

BACKGROUND OF THE INVENTION

The invention relates to a tangential belt drive for a plurality of similar work units for the production of twisted or twined yarns. These units are subdivided into sections, each of which has a tangential belt for driving the units. The number of units in each section is so established that the tangential belt has a width between 7 and 15 mm and a thickness between 2 and 2.7 mm. An arrangement of this type is reported in co-pending U.S. patent application Ser. No. 887,101 filed 10 July 1986, now U.S. Pat. No. 4,730,448.

Work units are defined as machine elements with high rotational speed. For instance, these units may be spindles in spinning- or twisting machines, or rotors and opening rollers in open-end spinning machines.

In this construction mentioned above it has already been proposed that the work units of the machine be driven in groups each by one of several endless tangential belts. Each tangential belt can be hereby driven by a motor. The guiding rollers of neighboring tangential belts are corotationally connected to each other thereby creating a frictional contact between the respectively neighboring tangential belts. As a result there is insured at least an approximately synchronous run of the tangential belts and that this goal can be reached under certain production conditions. So, for instance, at the start and conclusion of a run, the machine might require a redistribution of energy between the working elements and groups of working elements with different starting and tapering-off characteristics, so as to achieve an at least approximately synchronous run of the energy-releasing and energy-receiving working elements. Such differences in starting and stopping characteristics can, for instance, result from groups being of various size formed by working units of the same type. Alternatively, these differences can occur when an at least approximate synchronization between different types of work units is sought; for instance, beween spindles of a ring spinning frame, on the one hand, and the drafting mechanism, on the other hand.

Of course, there will always be a tendency to insure the required synchronous run even in starting and stopping stages through corresponding control of the drive motors, so that the mechanical coupling of the groups of work elements via the tangential belts has to effect solely the fine-tuning of the rotational speeds. However, particularly when under special conditions, such as power failures, the corresponding control of the motors is no longer possible, the frictional contact created by the corotational connection between the guide rollers has to be strong enough to produce the required synchronization.

An essential factor determining the strength of this friction contact is the contact angle at which the tangential belt wraps around its guide rollers. The sum of all contact angles at all guide points of a tangential belt guided only in one direction is, as can be seen from FIG. 1, equal to 360°. This angle sum can be distributed differently over the various guiding elements, in function of their arrangement, but will always remain equal to 360°.

As can be seen from FIG. 1, 180° of the 360°, which means one half, is always assigned for the guiding at both return points of the tangential belt. At the right drive-side end, the two guide rollers and the drive pulley divide between them this 180° deflection. It has become obvious, that hereby, corresponding to the division of the angle sum, either the contact angle on the roller or the contact angle on the pulley become too small to insure the required friction contact especially under extreme situations.

It is therefore the object of the present invention to increase the frictional contact between the tangential belts, on one hand, and the guide rollers and the drive pulley on the other hand. Another object is to improve this way the energy transmission from the motor to the tangential belts, as well as between the tangential belts.

SUMMARY OF THE INVENTION

These objects are attained according to the invention by increasing the sum of the belt contact-angles to more than 360°. In a first embodiment expansion to beyond 360° is achieved by subjecting the belt to an additional deflection by guiding it in a reversed curve. In another embodiment, expansion is achieved by utilization of a further intermediate belt, whose sum of contact angles is added to the sum of contact angles of the main tangential belt. Several variations on both these basic embodiments are hereinbelow reported which can be suitably selected and/or combined, depending on the circumstances and conditions of the respective application.

The embodiment with a tangential-belt guided in reversed curve has the advantage of simplicity. In this case, it is possible to achieve, without complicated structures, contact angles of up to 180° at the drive pulleys and the guide rollers. A higher degree of looping, usually associated with a stronger flexure, and therefore with more fulling and energy losses in the belt, can only be pushed as far as it seems to be required for the desired energy transmission. This limit is higher in the case of a narrow and/or particularly a thin belt than in a wider and/or thicker belt. Looping of both sides of a belt over power-transmitting elements, such as drive pulleys and guide rollers, is useful only when the belt is provided on both sides with corresponding surfaces.

A particularly advantageous object of the invention consists in corotationally connecting to each other also the guiding elements additionally assigned to the tangential belt, so that these additional guide rollers not only increase the contact angles at the drive pulleys and the already available guide rollers, but also that their own contact angles become additionally effective for the energy transmission between the tangential belts.

Guiding the belt in a reversed curve increases the load on the belt, due to its alternate bending. This problem is avoided in the second embodiment of the invention. Normally, contact angles of 90° are available between all guide rollers and the main tangential belts. According to the invention, the total contact angle of the intermediate belt is divided only between two guide rollers and one drive pulley. This way, contact angles of considerably more than 90° are reached.

In further developments of the invention, two guide roller elements, located opposite to each other, can be connected to at least one of the motors over at least one common drive belt. Besides the mutually coupled guide rollers, the guide roller elements can have hereby a drive pulley at least partially surrounded by the drive belt. Thereby, for the guide roller a contact angle of 90° results, while the contact angle for the drive pulley amounts to 120°.

According to another embodiment of the invention, the drive belt can run over the area of a guide roller element, over whose external side also one of the tangential belts is running. In this case, at each of the two guide roller elements, an additional roller for the drive belt is advantageously eliminated, and overall dimensions may be reduced for the entire arrangement.

According to another feature of the invention, each guide roller element can be associated with a drive belt. In other cases, it is advantageous when along one side of the machine, only each second guide roller element is associated with a drive belt.

According to yet another feature of the invention, the possibility exists that at least one tangential belt in the area between the two guide rollers is equipped with a tensioning device. In further embodiments, instead of this arrangement, the drive belt itself can be, for instance, equipped with a tensioning device.

The drive belt can be in a manner per se either flat- or profiled, or for instance constructed as a toothed belt, so that it is possible to achieve optionally either a frictional contact or a form-locking contact.

BRIEF DESCRIPTION OF THE DRAWING

The invention in several of its embodiments will now be described in further detail with the aid of the accompanying drawing in which.

DETAILED DESCRIPTION

Figure 1:
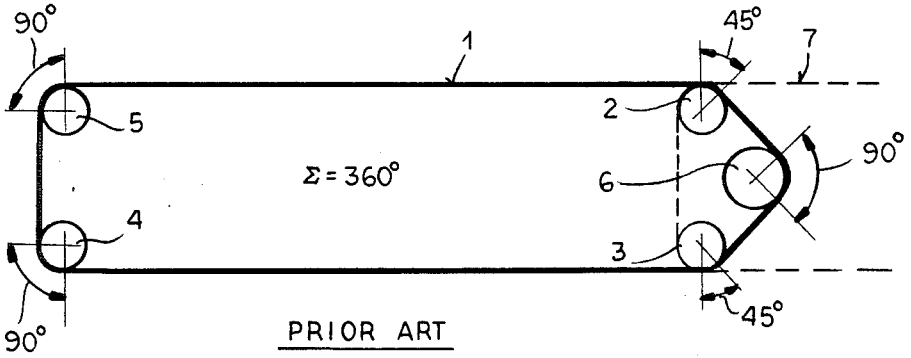
FIG. 1 illustrates a plan view of an individual tangential belt which is in frictional contact with a row of neighboring belts, according to the prior art.

FIG. 1 clarifies how the sum of the contact angles of 360° of a tangential belt 1 according to the state of the art is distributed over four guide rollers 2, 3, 4 and 5 as well as over a drive pulley 6. It can be seen that the contact angles at the guide rollers 2 and 3 amount to only 45° and to only 90° at the drive pulley 6, which gives a total of 180°. The distribution of these 180° can be changed by displacing the drive pulley 6. However, when the contact angle at the drive pulley 6 is increased, the contact angles at the guide rollers 2 and 3 are diminished, and vice versa. A small contact angle at the guide rollers 2 and 3, however, impairs the frictional contact between the tangential belt 1 and the guide rollers, and thereby the possibility of energy transmission to a neighboring tangential belt 7. A small contact angle at the drive pulley 6 reduces the frictional contact between this pulley and the tangential belt 1 and thereby the transmission of the drive energy to the tangential belt.

Figure 2:
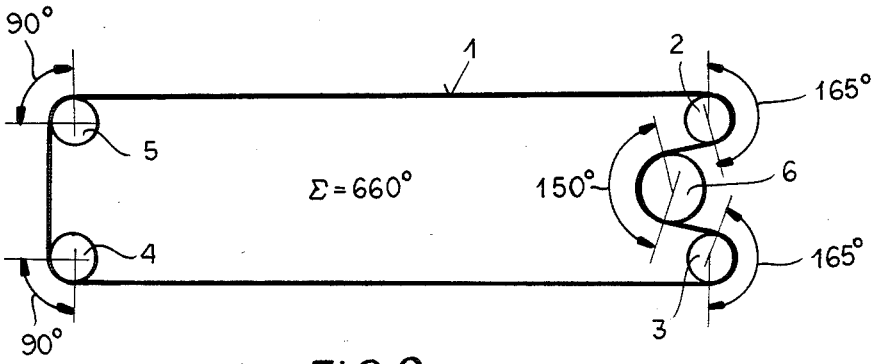
FIG. 2 illustrates a first embodiment based on the principle of the invention.

FIG. 2 clarifies how the contact angles at the guide rollers 2 and 3 and the drive pulley can be considerably increased: the tangential belt 1 is guided in reversed curve by displacing the drive pulley 6. This way, contact angles at the guide rollers 2 and 3 and at the drive pulley 6 reach 165° and 150°, respectively.

Figure 3:
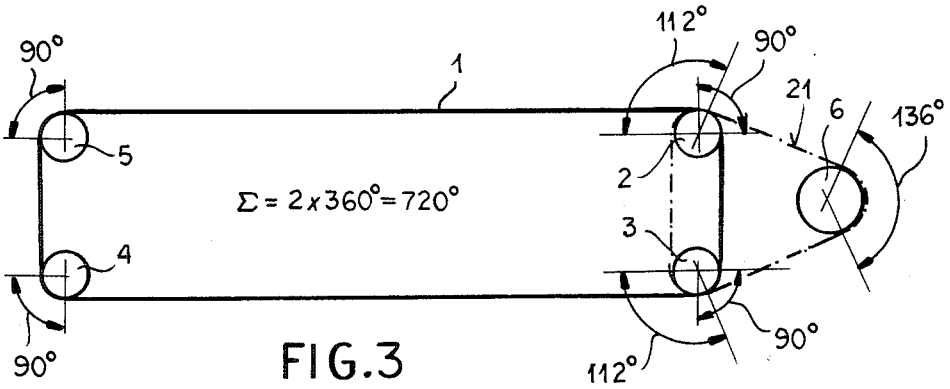
FIG. 3 illustrates a second embodiment based on the principle of the invention.

FIG. 3 shows a further increase in the contact angle by displacing the pulley 6 to a position spaced to the right of pulleys 2 and 3 so that a second belt 21 passes around the pulleys 2 and 3 in looping around the pulley 6 with a contact angle of 360° in addition to the contact angle of 360° for the belt 1 and a total contact angle of 720°.

Figure 4:
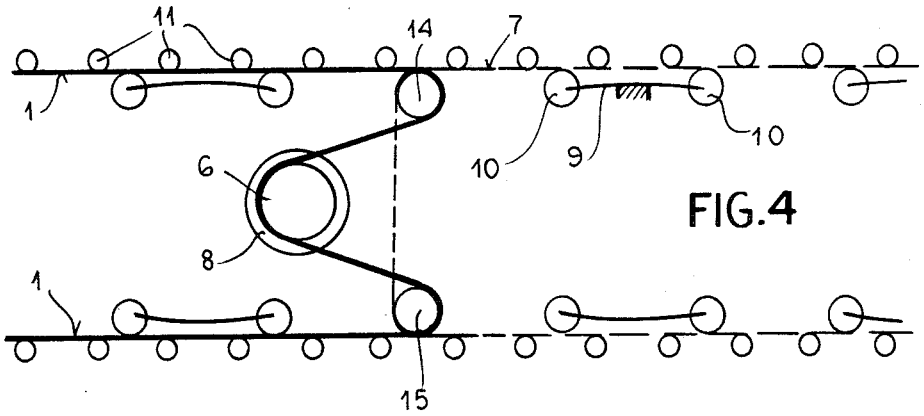
FIGS. 4–7 illustrate in various schematic top views belt arrangements within the general embodiment shown in FIG. 2.

In the embodiment according to FIG. 4, which is a drive system for a ring spinning machine, the two neighboring tangential belts 1 and 7 are driven by the drive pulley 6 of a motor 8. Along the ring spinning machine, pairs of pressure rollers 10, acted upon by a rigidly mounted spiral spring 9, insure that the tangential belts 1 and 7, respectively, are securely in contact with whorl 11 of the working elements and spindles (not shown in the drawing). The two tangential belts 1, 7 are offset in height with respect to each other, and guided around guide rollers 3 and 18, respectively, corotationally coupled to each other, forming the guide roller elements 14 and 15.

Figure 5:
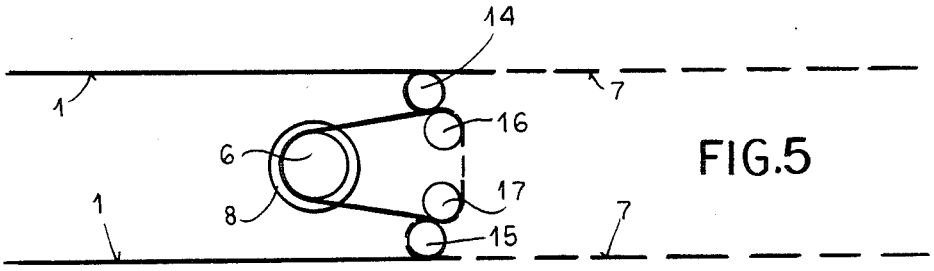

In the construction according to FIG. 5, besides the guide rollers 14 and 15, at the longitudinal center line of the machine, two further guide rollers 16 and 17 are provided in the machine. Thereby, the tangential belt 1 runs around the guide roller element 14, the drive pulley 6 and the guide roller element 15. By contrast, the tangential belt 7 runs around all four guide roller elements 14, 16, and 17, 15, i.e. both guide roller elements of each pair are surrounded by the tangential belt 7. Thereby the looping of the belt is doubled from 90° (FIG. 1) to about 180° around the guide roller elements 14 and 15 which effects the frictional contact and the energy transmission between the tangential belts 1 and 7. Through this arrangement it is possible to considerably increase transmission of energy.

Figure 6:
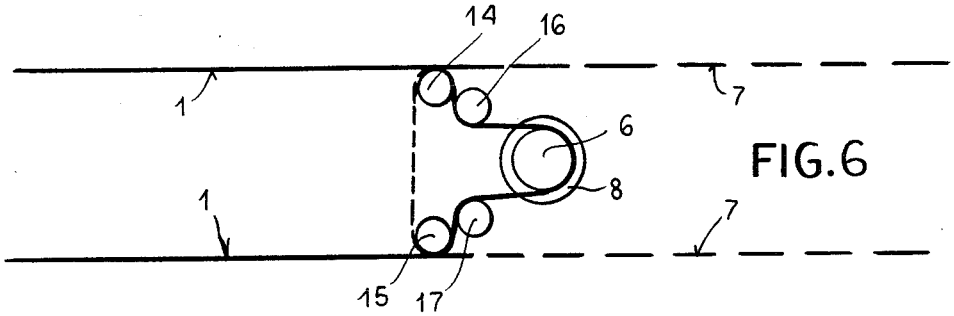

According to FIG. 6, it is also possible in a guide roller arrangement like the one in FIG. 5 to locate the motor 6 on the other side, which means in the area of the tangential belt 7. Thereby, the tangential belt 1 surrounds both guide roller elements 14 and 15 with its inner side and the guide roller elements 16 and 17 with its exterior side. The drive pulley 6 of the motor 8 is hereby surrounded at an angle of 180° even. The tangential belt 7 surrounds only the two guide roller elements 16 and 17, each at an angle of approx. 90°.

Figure 7:
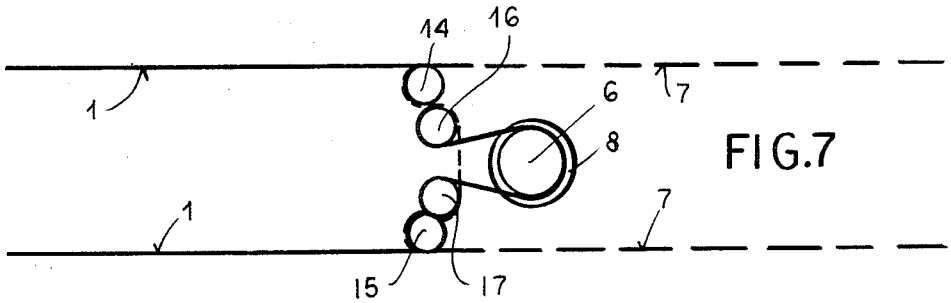

In the embodiment according to FIG. 7, the tangential belt 7 also loops around both guide roller elements 16 and 17 with its external side. Hereby, the two guide roller elements 14, 16 and 15, 17, respectively, are surrounded by both tangential belts 1 and 7 with arches each bigger than 90. A particularly close frictional contact is here achieved, permitting the transmission of a large amount of energy between the two tangential belts 1 and 7. Thereby equality can be easily achieved between the sums of the contact angles of both tangential belts 1 and 7 around all four guide roller elements due to the corresponding arrangement of the guide roller elements 16 and 17. In all embodiments, the guide roller elements are arranged so that the strands of the tangential belts 1 and 7, running in the longitudinal direction of the machine, are oriented tangentially to the guide rollers. The drive motor 8 with the drive pulley 6 is located in the middle of the machine and is offset with respect to the plane connecting the two guide roller elements by a distance corresponding at least to half the distance between the strands running along the two sides of the machine of the tangential belts 1 and 7.

In the embodiment of FIG. 5 it is provided that the guide roller elements 16 and 17 be arranged between the two outer guide roller elements 14 and 15 and deflect the tangential belt 7 running between these two guide roller elements 14 and 15, with respect to the tangential connection plane between the guide roller elements 14 and 15 by more or at least by the diameter of the guide rollers of these guide roller elements.

The embodiment according to FIG. 6 is so constructed that the guide roller elements 16, 17 deflect the path of the belt running from the guide rollers of the guide roller elements 14, 15 to the drive pulley 6 by approximately the diameter of the guide roller, in such a manner that the belt path directions running from and to the drive pulley are approximately parallel to each other.

FIG. 7 represents a combination of the features of FIG. 5 and FIG. 6. The tangential belt 1 runs hereby analogously to the running direction of the tangential belt 1 according to FIG. 6; the tangential belt 7 runs hereby analogously to the direction of the tangential belt 7 in FIG. 5.

The guide roller elements arranged in neighboring pairs 14, 16 and 15, 17, respectively, as shown in FIGS. 5–7 can be mechanically coupled. This coupling can be achieved for instance through mutually meshing gears, whereby a possibly required energy shift is also supported.

In the embodiments of FIG. 3, as well as 8 to 13, the two neighboring tangential belts 1 and 7 run over two common guide roller elements 14 and 15. The tangential belt 1 runs over the guide roller 3 and the tangential belt 7 over the guide roller 18 of the guide roller element 15. Both guide rollers 3 and 18 are corotationally coupled to each other. On the shaft 19 of these two guide rollers 3, 18, there is drive pulley 20, also corotationally connected, which is in connection with the motor 8 over the belt drive 21 and the drive pulley 6. The other guide roller element 14 is built the same way and located oppositely from guide roller element 15 with respect to the longitudinal center line and the median plane of the machine. The tangential belts 1 and 7, via the whorl 11, drive a plurality of working units distributed over the length of the machine, as for instance spinning spindles indicated only by their axes 22. Work units are defined here as machine elements with a high rotational speed, such as for instance spindles in spinning and yarn-twisting machines, or rotors and opening rollers in open-end spinning machines.

Guide roller elements 14 and 15 are driven by the drive belt 21 and, in turn, transmit the drive to the tangential belts 1 and 7. As can be seen from FIG. 9, in this case the contact angles are large, namely 125° for the guide rollers and the guide roller elements 14 and 15 and 120° for the drive pullley 6 connected to the motor 8.

Figure 9:
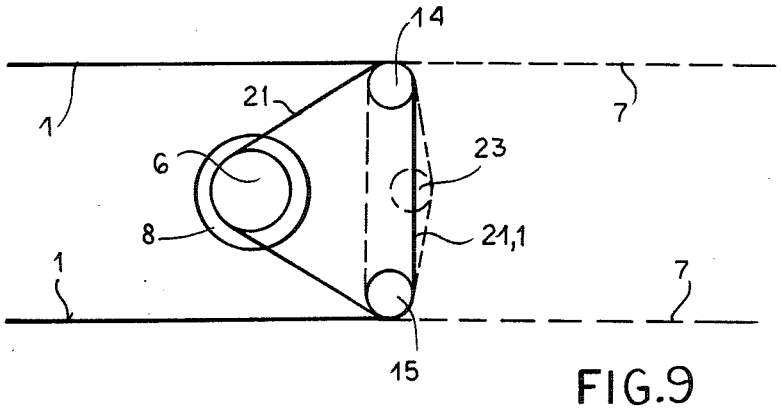
FIG. 9 illustrates a top view of the construction according to FIG. 8.

As can also be seen from FIG. 9, there is the possibility to maintain the required belt tension of the drive belt 21, as well as at the tangential belt 1 and 7, respectively, by means of tensioning devices. A roller 23 subject to spring compression can be used as tensioning device, this roller deflecting the belt until it reaches the required tensioning.

Figure 8:
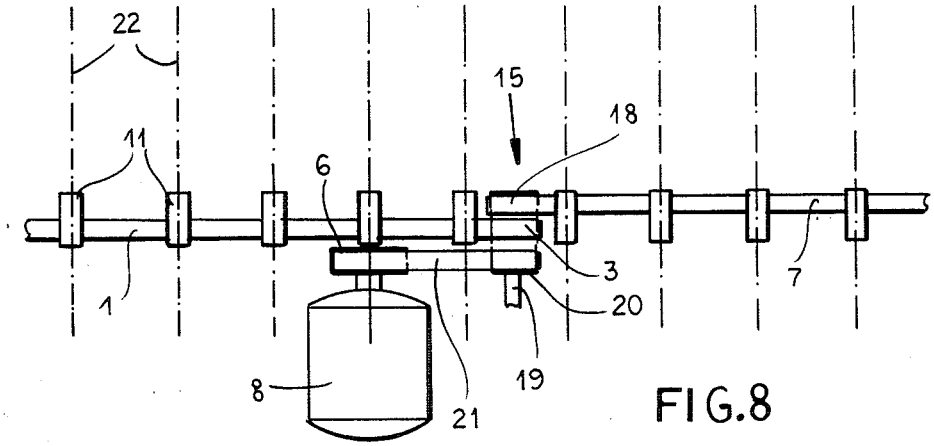
FIG. 8 illustrates a schematic side view of a belt arrangement with the general embodiment shown in FIG. 3.
Figure 10:
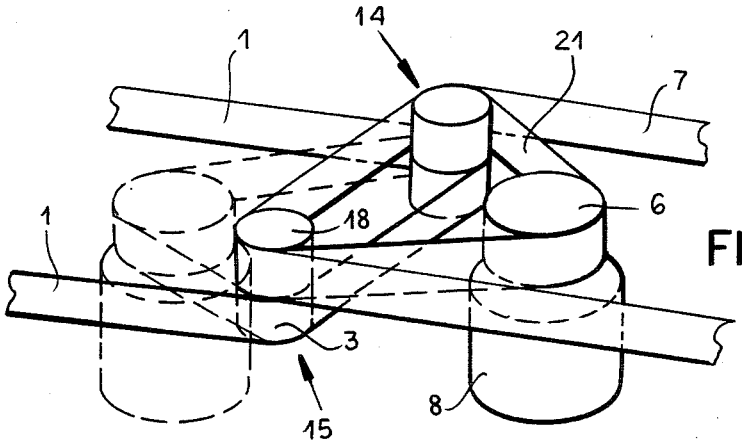
FIGS. 10–11 illustrate two further embodiment possibilities of the belt drive in a perspective, partially broken, view.
Figure 11:
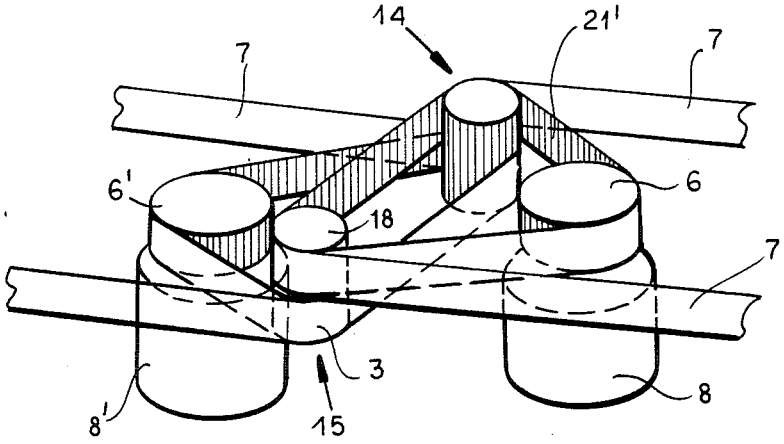

FIGS. 10 and 11 show embodiments wherein the drive pulley 20 shown in FIG. 8 on the guide roller elements 14 and 15, respectively, is dispensed with. Instead, the drive belt 21 runs over the guide roller 18 of the guide roller element 15 and theguide roller of the same kind of the guide roller element 14. In the area between the two guide rollers 14 and 15, the tangential belt 7 rests against the drive belt 21 and is entrained by it as a result of friction. The drive belt 21 drives the guide roller elements 14 and 15, which transmit this motion to the the tangential belt 1. In order to insure the same running speed for both tangential belts 1 and 7, the guide rollers, over which the tangential belt 7 as well as the drive belt 21 run, have to have a radius smaller by the thickness of the belt of the drive belt 21 than the radius of the guide rollers over which only the tangential belt 1 runs.

According to FIG. 10, there is lso a possibility, shown in broken lines, to locate the motor 8 on the other side of the guide roller elements 14 and 15. It runs then under the tangential belt 1 over these guide rollers.

In the embodiment of FIG. 10, flat belts are used to achieve frictional connection and frictional entrainment. In the construction according to FIG. 11, a toothed belt is used as drive belt 21', which cooperates with a corresponding tooth system on the drive pulley 6 and the guide roller elements 14 and 15. A form-locking connection is established through this arrangement between the motor 8 and the guide roller elements 14 and 15. In the area between the guide roller elements 14 and 15, the tangential belt 7 comes to rest against the drive belt 21', whereby a frictional connection is established.

In some cases, it is advantageous to assign simultaneously to one pair of guide rollers 14, 15 the motors 8 and 8' shown in FIG. 11, with their belt drives.

Figure 12:
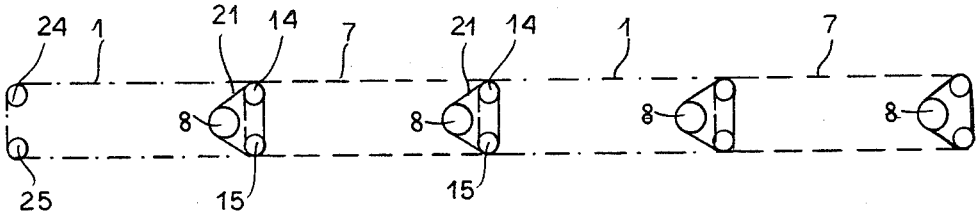
FIGS. 12–13 illustrate two further embodiments of the belt drive according to the invention, in schematic top view.

FIG. 12 shows a schematic top view of an entire tangential drive belt system of a machine for the production of twisted or twined yarn. Therein, between each two neighboring tangential belts 1 and 7 is provided a motor 8 and a drive belt 21 driving two oppositely located guide roller elements 14 and 15. This way, each of the tangential belts 1 and 7 are subjected to a double actuation by two neighboring motors 8. Due to the guide roller elements 14 and 15, each effectively connecting the tangential belts 1 and 7 with each other, there is insured an unimpaired synchronous run of the tangential belts.

Figure 13:
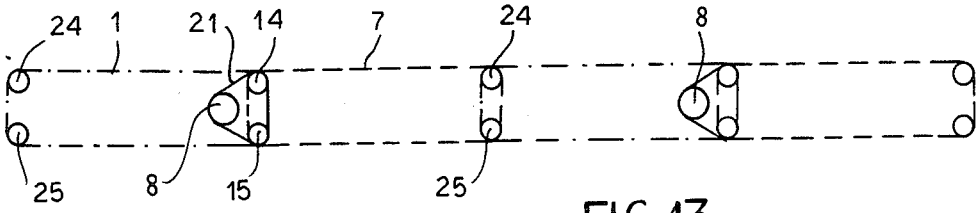

In the embodiment according to FIG. 13, only two neighboring tangential belts 1 and 7 are driven via a motor 8 and a drive belt 21. Between each of the two motors there are guide rollers 24 and 25 which have no drive. The tangential belt 1 shown on the left side runs over the guide rollers 24 and 25, as well as over the guide roller elements 14 and 15. Tangential belt 7 arranged to the right runs over the same guide roller elements 14 and 15 and over the guide rollers 24 and 25 is located to their right. Both neighboring tangential belts 1 and 17 are driven over the drive belt 21, which is driven over the driving pulley of the motor 8. This drive belt 21 runs over the drive pulley 20—a closeup view shown in FIG. 8—of the guide roller element 15, as well as over the corresponding drive pulley of the guide roller element 14.

Due to the additional drive belt 21 it is possible to arrange the motor 8 within the machine, in an easy manner and insuring good access. Despite the indirect drive, a good power transmission results from the very advantageous contact angles at the driving and driven elements, particularly when at least some of the transmission elements have form-locking connections. If, in addition thereto, the drive belt 21 lies in the area of the tangential belt 1 or 7, respectively, there is no increase in the overall dimensions of the drive system.

We claim:

1. Tangential belt drive for a machine used in the production of twisted or twined yarns comprising:

a plurality of work units of the same kind arranged in at least one row next to each other, the work units being subdivided into sections with at least approximately the same number of units;

respective belt means including at least one endless tangential belt to drive said work units of each of said sections, said belt having a width between 7 and 15 mm and a thickness between 2 and 2.7 mm; and at least one driving electromotor and guide means for said one of said tangential belts, the guide means for each tangential belt including a pair of guide rollers remote from said pulley and a pair of guide rollers engaged by the respective belt and proximal to the respective drive pulley, said guide rollers proximal to said drive pulley and said drive pulley being engaged by said belt means with respective contact angles and being positioned so that the sum of said angles is at least 360° for the belt means of each section, the guide rollers of at least some of said sections being common to and forming a guide means for the belt means of an adjacent section whereby the belt means of successive ones of said sections run substantially synchronously.

2. The tangential belt drive according to claim 1, further comprising a respective separate drive belt connecting the drive pulley and the guide rollers proximal to said drive pulley and contributing to the sum of said contact angles.

3. The tangential belt drive according to claim 1 wherein each of said tangential belts engages a respective one of said drive pulleys.

4. The tangential belt drive according to claim 3 wherein each drive pulley of a respective tangential belt is located between the pairs of guide rollers of the respective belt means.

5. The tangential belt drive according to claim 3 wherein adjacent to each of said pairs of guide rollers forming a first pair is a second pair of guide rollers which are contacted by a neighboring tangential belt of an adjoining one of said sections.

6. The tangential belt drive defined in claim 5 wherein each of said tangential belts contacts the guide rollers of one of the first and second pair with its outer surface and the guide rollers of the other of said first and second pairs with its inner surface.

7. The tangential belt drive according to claim 5 wherein the drive pulley of the belt means of one of said tangential sections is located between the pairs of guide rollers of an adjacent section.

8. The tangential belt drive defined in claim 5 wherein one of said tangential belts loops around the rollers of one of said first and second pairs while a tangential belt of an adjacent section loops about the rollers of both of said first and second pairs.

9. The tangential belt drive according to claim 5 wherein both neighboring tangential belts loop around each guide roller of both of said first and second pairs.

10. The tangential belt drive according to claim 5 wherein the two guide rollers of the second pair of guide rollers are corotationally connected to each other.

11. The tangential belt drive according to claim 5 wherein both guide rollers of each of said first and second pairs are coupled to each other by a mechanical coupling.

12. The tangential belt drive according to claim 11 wherein the mechanical coupling comprises two mutually meshing gears.

13. The tangential belt drive according to claim 1 wherein a plurality of motors are provided, each motor being arranged at a distance from a respective tangential belt of a respective section being connected by said separate drive belt with at least one of the pairs of guide rollers of the respective section proximal to the respective drive pulley and forming a first pair.

14. The tangential belt drive according to claim 13 wherein the first pair guide roller elements comprise mutually coupled guide rollers and a drive roller engaged by the respective separate drive belt.

15. The tangential belt drive according to claim 13 wherein the drive belt runs over an area of the first pair of guide rollers, an outer perimeter of said area being at least partially defined by the tangential belts.

16. The tangential belt drive according to claim 13 wherein each guide roller is connected with a drive belt.

17. The tangential belt drive according to claim 13 wherein along a side of the machine only each second guide roller element is connected with a respective one of said drive belts.

18. The tangential belt drive according to claim 13, wherein such drive belt is provided with a tensioning device.

19. The tangential belt drive according to claim 13 wherein at least one of two neighboring tangential belts is equipped with a tensioning device in an area between two guide rollers located opposite to each other with respect to a longitudinal median plane of the machine.

20. The tangential belt drive according to claim 13 wherein the drive belt is a flat belt.

21. The tangential belt drive according to claim 13 wherein the drive belts have form-locking connections with the respective guide rollers and drive pulleys.

* * * * *